US011792596B2

(12) United States Patent
Fazi et al.

(10) Patent No.: US 11,792,596 B2
(45) Date of Patent: Oct. 17, 2023

(54) LOUDSPEAKER CONTROL

(71) Applicant: Audioscenic Limited, Southampton (GB)

(72) Inventors: Filippo Maria Fazi, Southampton (GB); Eric Hamdan, Southampton (GB); Andreas Franck, Southampton (GB); Marcos Simón, Southampton (GB)

(73) Assignee: AUDIOSCENIC LIMITED, Southampton (GB)

( * ) Notice: Subject to any disclaimer, the term of this patent is extended or adjusted under 35 U.S.C. 154(b) by 0 days.

(21) Appl. No.: 17/339,614

(22) Filed: Jun. 4, 2021

(65) Prior Publication Data

US 2021/0385605 A1 Dec. 9, 2021

(30) Foreign Application Priority Data

Jun. 5, 2020 (GB) ..... 2008547

(51) Int. Cl.
*H04S 7/00* (2006.01)
*H04R 5/02* (2006.01)
(Continued)

(52) U.S. Cl.
CPC ..... *H04S 7/303* (2013.01); *H04R 5/02* (2013.01); *H04S 7/308* (2013.01)

(58) Field of Classification Search
None
See application file for complete search history.

(56) References Cited

U.S. PATENT DOCUMENTS 6,243,476 B1 6/2001 Gardner
2006/0062410 A1* 3/2006 Kim ..... H04S 7/302 381/310

(Continued)

FOREIGN PATENT DOCUMENTS

EP 2 930 953 A1 10/2015
EP 3 024 252 A1 5/2016

(Continued)

OTHER PUBLICATIONS

Choueiri, E. Y., "Optimal Crosstalk Cancellation for Binaural Audio with Two Loudspeakers," Princeton University, 24 pages (2010).

(Continued)

*Primary Examiner* — Qin Zhu
(74) *Attorney, Agent, or Firm* — Hamilton, Brook, Smith & Reynolds, P.C.

(57) ABSTRACT

There is provided a method of controlling an array of loudspeakers. The method comprises: receiving a plurality of input audio signals to be reproduced, by the array, at a respective plurality of control points in an acoustic environment; and generating a respective output audio signal for each of the loudspeakers in the array by applying a set of filters to the plurality of input audio signals. The set of filters is based on: a first plurality of filter elements based on a first approximation of a set of transfer functions, each transfer function in the set of transfer functions being between an audio signal applied to a respective one of the loudspeakers and an audio signal received at a respective one of the control points from the respective one of the loudspeakers; and a second plurality of filter elements based on a second approximation of the set of transfer functions.

18 Claims, 10 Drawing Sheets

(51) Int. Cl.

| | |
|---|---|
| ***H04R 3/12*** | (2006.01) |
| ***G10L 21/0208*** | (2013.01) |
| ***H04R 5/04*** | (2006.01) |

(56) References Cited

U.S. PATENT DOCUMENTS

| | | | | |
|---|---|---|---|---|
| 2008/0025534 | A1 | 1/2008 | Kuhn et al. | |
| 2008/0273714 | A1 | 11/2008 | Hartung | |
| 2010/0150361 | A1 | 6/2010 | Kim et al. | |
| 2011/0103625 | A1* | 5/2011 | Srinivasan | G10L 21/0208 381/107 |
| 2012/0014525 | A1* | 1/2012 | Ko | H04S 7/40 381/17 |
| 2013/0279723 | A1 | 10/2013 | Hooley et al. | |
| 2014/0270187 | A1 | 9/2014 | Hall et al. | |
| 2016/0080885 | A1 | 3/2016 | Hampiholi et al. | |
| 2017/0332184 | A1* | 11/2017 | Lacouture Parodi | H04S 7/30 |
| 2017/0347216 | A1* | 11/2017 | Khabbazibasmenj | H04R 3/12 |
| 2018/0192226 | A1* | 7/2018 | Woelfl | H04R 5/033 |
| 2019/0090060 | A1* | 3/2019 | Fazi | H04R 3/12 |
| 2020/0374624 | A1 | 11/2020 | Koschak et al. | |
| 2021/0204085 | A1* | 7/2021 | Claar | H04S 7/305 |
| 2023/0007424 | A1 | 1/2023 | Fazi et al. | |

FOREIGN PATENT DOCUMENTS

| | | | |
|---|---|---|---|
| WO | WO 2012/036912 | A1 | 3/2012 |
| WO | WO 2012/068174 | A2 | 5/2012 |
| WO | WO 2014/151817 | A2 | 9/2014 |
| WO | WO 2017/063688 | A1 | 4/2017 |
| WO | WO 2017/158338 | A1 | 9/2017 |
| WO | WO 2017/201603 | A1 | 11/2017 |

OTHER PUBLICATIONS

Hamdan E. C., et al., "Three-channel Crosstalk Cancellation Mode Efficiency for Sources in the Far-Field," Audio Engineering Society, Conference Paper 81, 10 pages (2019).

Kirkeby, O., et al., "Fast Deconvolution of Multichannel Systems Using Regularization," *IEEE Transactions on Speech and Audio Processing*, vol. 6, No. 2, (1998).

Kirkeby, O., "Digital Filter Design for Inversion Problems in Sound Reproduction," Surround Sound Processing, J. Audio Eng. Soc., vol. 47, No. 7/8, pp. 583-595 (1999).

Lentz, T., "Dynamic Crosstalk Cancellation for Binaural Synthesis in Virtual Reality Environments," *Engineering Reports, J. Audio Eng. Soc*., vol. 54, No. 4, pp. 283-294 (2006).

Masiero, B. and M. Vorländer, "A Framework for the Calculation of Dynamic Crosstalk Cancellation Filters," IEEE Transactions on Audio, Speech, and Language Processing, vol. 22, No. 9, 11 pages (2014).

Nelson, P. A. and S. J. Elliott, Active Control of Sound. London: Academic Press, 1992. (The_Hermitian_Quadratic_Form).

Nelson, P. A., et al., "Adaptive Inverse Filters for Stereophonic Sound Reproduction," IEEE Transactions on Signal Processing, vol. 40, No. 7, pp. 1621-1632 (1992).

Osmant, A., "3D Audio for 3D TV," Press Release—Cambridge Mechatronics and Princeton University's 3D3A Lab team up to offer 3D Sound for 3D TVs, 2 pages (2011).

Simón Gálvez, Marcos F. et al., "Time Domain Optimization of Filters Used in a Loudspeaker Array for Personal Audio," IEEE/ACM Transactions on Audio, Speech, and Language Processing, vol. 23, No. 11, 10 pages (Nov. 2015).

Simón Gálvez, Marcos F. et al., "A Robustness Study for Low-Channel-Count Cross-Talk Cancellation Systems," Audio Engineering Society Conference Paper 74, 9 pages (2019).

Xie, Bosun, "Binaural Reproduction through Loudspeakers," Chapter 9, Head-Related Transfer Function and Virtual Auditory Display. J. Ross Publishing, pp. 283-326 (2013).

Van Veen, B.D., and Buckly, K.M., "Beamforming: A Versatile Approach to Spatial Filtering," IEEE, ASSP Magazine, No. 5, pp. 4-24 (Apr. 1988).

Nelson, P.A., et al., "Inverse Filters for Multi-Channel Sound Reproduction," IEICE Trans. Fundamentals, E75-A (11): 1468-1473 (Nov. 1992).

* cited by examiner

LOUDSPEAKER CONTROL

RELATED APPLICATION

This application claims priority under 35 U.S.C. § 119 or 365 to Great Britain Application No. 2008547.8, filed Jun. 5, 2020. The entire teachings of the above application are incorporated herein by reference.

FIELD

The present disclosure relates to a method of controlling a loudspeaker array and a corresponding apparatus and computer program.

BACKGROUND

Loudspeaker arrays may be used to reproduce a plurality of different audio signals at a plurality of control points. The audio signals that are applied to the loudspeaker array are generated using filters, which may be designed so as to avoid cross-talk. However, the determination of the weights of these filters may be computationally expensive, particularly if the control points are moving and the filter weights thus need to be computed in real-time. This may, for example, be the case if the control points correspond to listeners' positions in an acoustic environment.

A previous approach to determining filter weights for a loudspeaker array is described in WO 2017/158338 A1.

SUMMARY

Aspects of the present disclosure are defined in the accompanying independent claims.

BRIEF DESCRIPTION OF THE DRAWINGS

Examples of the present disclosure will now be explained with reference to the accompanying drawings in which.

Throughout the description and the drawings, like reference numerals refer to like parts.

DETAILED DESCRIPTION

In general terms, the present disclosure relates to a method of controlling a loudspeaker array to reproduce a plurality of input audio signals at a respective plurality of control points in a manner that avoids cross-talk, i.e., that reduces the extent to which an audio signal to be reproduced at a first control point is also reproduced at other control points. A set of filters is applied to the input audio signals to obtain the plurality of output audio signals which are output to the loudspeaker array. The present disclosure relates primarily to ways of determining those filters.

Figure 1:
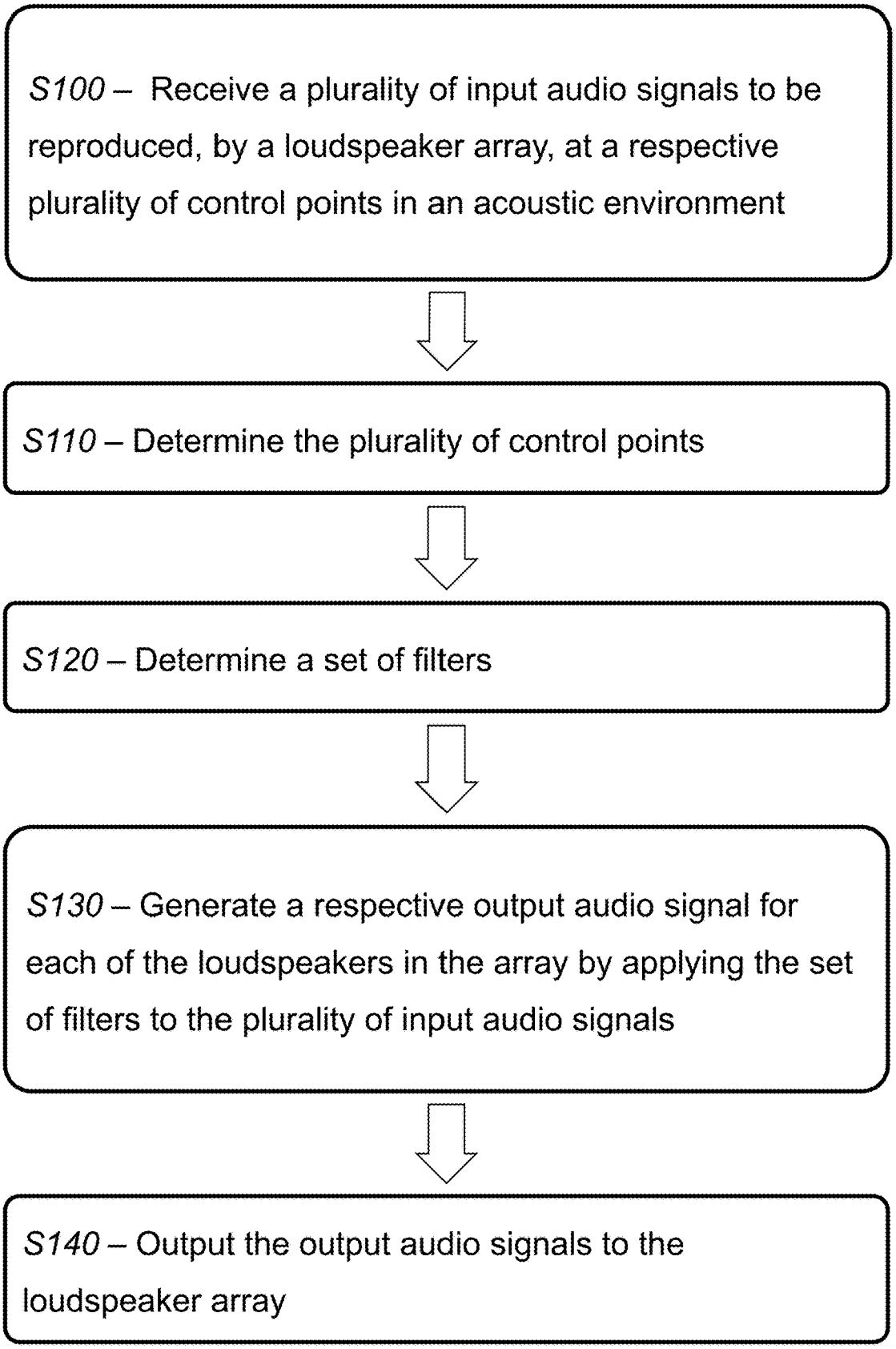
FIG. 1 shows a method of controlling a loudspeaker array.

A method of controlling the loudspeaker array is shown in FIG. 1.

At step S100, a plurality of input audio signals to be reproduced, by a loudspeaker array, at a respective plurality of control points in an acoustic environment are received.

At step S110, the plurality of control points may be received using a position sensor. In particular, the position of each of the plurality of control points may be received or determined.

At step S120, a set of filters may be determined. If step S110 is performed, the set of filters may be determined based on the determined plurality of control points. Alternatively, the set of filters may be determined based on a predetermined plurality of control points. The manner in which the set of filters is determined is described in detail below.

At step S130, a respective output audio signal for each of the loudspeakers in the array is determined by applying the set of filters to the plurality of input audio signals.

The set of filters may be applied in the frequency domain. In this case, a transform, such as a fast Fourier transform (FFT), is applied to the input audio signals, the filters are applied, and an inverse transform is then applied to obtain the output audio signals.

At step S140, the output audio signals may be output to the loudspeaker array.

Steps S100 to S140 may be repeated with another plurality of input audio signals. As steps S100 to S140 are repeated, the set of filters may remain the same, in which case step S120 need not be performed, or may change.

As would be understood by a skilled person, the steps of FIG. 1 can be performed with respect to successively received frames of a plurality of input audio signals. Accordingly, steps S100 to S140 need not all be completed before they begin to be repeated. For example, in some implementations, step S100 is performed a second time before step S140 has been performed a first time.

Figure 2:
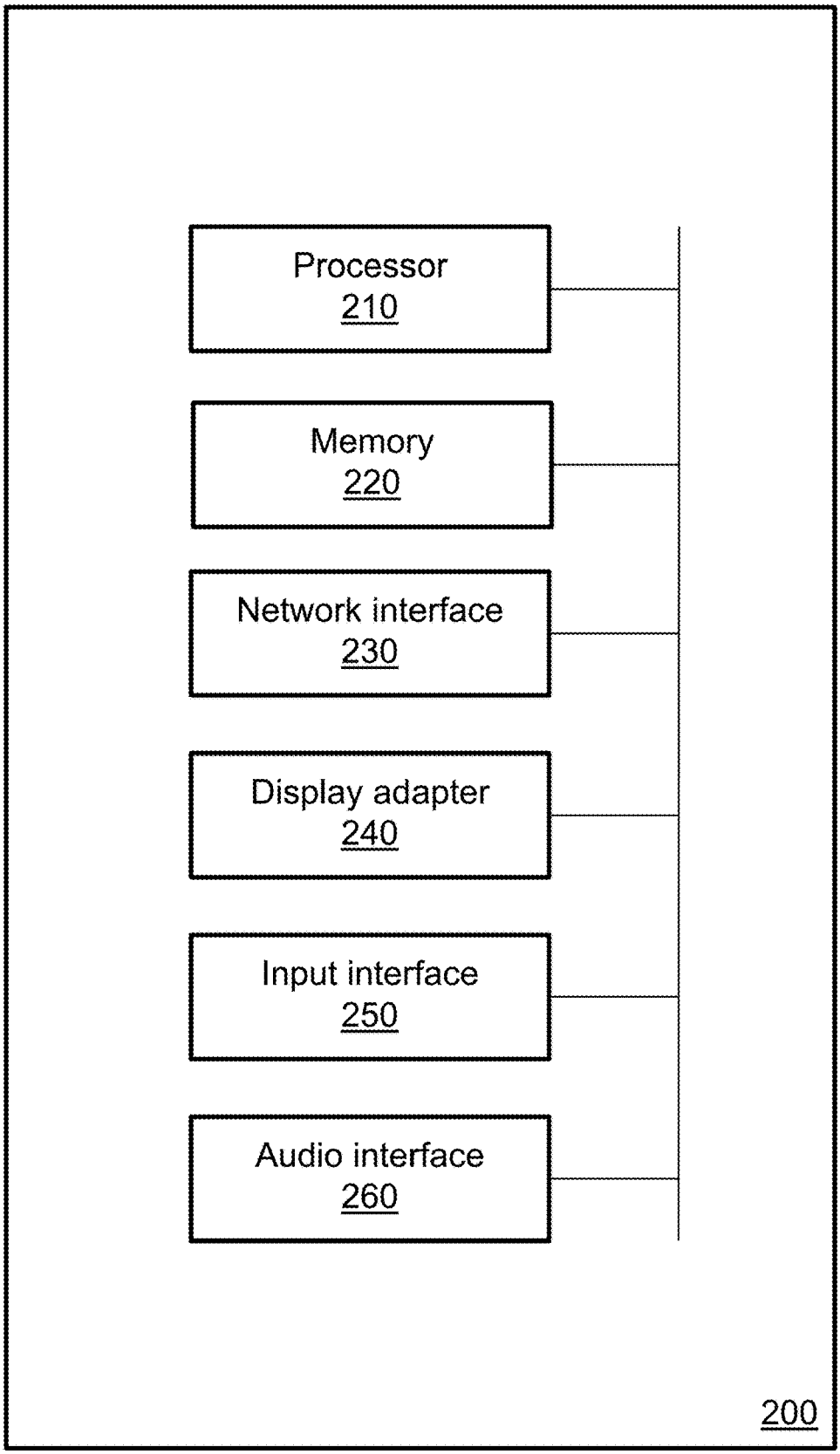
FIG. 2 shows an apparatus for controlling a loudspeaker array which can be used to implement the method of FIG. 1.

A block diagram of an exemplary apparatus 200 for implementing any of the methods described herein, such as the method of FIG. 1, is shown in FIG. 2. The apparatus 200 comprises a processor 210 (e.g., a digital signal processor) arranged to execute computer-readable instructions as may be provided to the apparatus 200 via one or more of a memory 220, a network interface 230, or an input interface 250.

The memory 220, for example a random-access memory (RAM), is arranged to be able to retrieve, store, and provide to the processor 210, instructions and data that have been stored in the memory 220. The network interface 230 is arranged to enable the processor 210 to communicate with a communications network, such as the Internet. The input interface 250 is arranged to receive user inputs provided via an input device (not shown) such as a mouse, a keyboard, or a touchscreen. The processor 210 may further be coupled to a display adapter 240, which is in turn coupled to a display device (not shown). The processor 210 may further be coupled to an audio interface 260 which may be used to output audio signals to one or more audio devices, such as a loudspeaker array 300. The audio interface 260 may comprise a digital-to-analog converter (DAC) (not shown), e.g., for use with audio devices with analog input(s).

Various approaches for determining the set of filters are now described.

Context

Listener-adaptive based cross-talk cancellation (CTC) 3D audio systems rely on multiple control filters to generate the sound driving one or more loudspeakers. The parameters of these filters are adapted in real-time according to the instantaneous position of one or more listeners, which is estimated with a listener tracking device (for example, a camera, global positioning system device, or wearable device). This filter parameter adaptation requires expensive computational resources, thus making the use of such audio reproduction approaches difficult for small embedded devices. Part of the computational resource consumption comes from the need for multiple inverse filters, which follows from the use of complex, accurate transfer function models between the system loudspeakers and the ears of a given listener. Simpler acoustical transfer functions can be used to reduce the computational load, but this comes at the cost of a reduced quality of the reproduced audio, especially in terms of its perceived spatial attributes. It is therefore difficult to create a system that is adaptive, has a low computational load, and has high quality performance.

Listener-adaptive CTC systems can be based on stereo loudspeaker arrangements. Listener-adaptive systems can also use arrangements of four loudspeakers in order to give the listener the ability to rotate their head and hear sounds from a 360 degree range. These listener-adaptive CTC system examples use time-varying signal-processing control approaches in order to adapt to time-varying listener positions and head orientations. The control filters can be read from a database, or calculated on the fly at significant computational cost. Whilst such signal processing approaches can be implemented using large central processing units (CPUs) such as those available in personal computers (PCs), their underlying signal processing becomes a limiting factor on embedded systems when using more than two loudspeakers.

CTC-based 3D audio systems have an improved response when more than two loudspeakers are used. These can be used with a non-listener adaptive, fixed approach. However, such an approach may be ill-suited to consumer applications as they assume the listener stays still in a single listening position.

From a signal processing point of view, the main problem with many approaches is that they are based on 'classic' multiple input multiple output (MIMO) signal flows requiring M×L control filters—M being the number of acoustic pressure control points (normally one for each of the listeners' ears) and L the number of loudspeakers of the loudspeaker array. For a two-loudspeaker system, only four filters would be needed; however twice as many would be needed if the system were to be made listener adaptive, and if more loudspeakers are to be used, the processing cost grows very quickly.

The technology described in WO 2017/158338 A1, hereafter referred to as 'Technology 1', allows for processing-efficient listener-adaptive audio reproduction with loudspeaker arrays using more than two loudspeakers. The main CPU overhead (or consumption) reduction introduced by the Technology 1 results from decomposing the filtering signal processing audio flow into a combination of loudspeaker-dependent filters (DF) and loudspeaker-independent filters (IF). In the Technology 1, the IFs are implemented as a set of time-varying finite impulse response (FIR) filters, whilst the DFs are implemented as a set of time-varying gain-delay elements. Due to this decomposition, only M×M control filters and M delay lines with L reading points each are needed. This processing scheme introduces a large reduction in processing complexity compared with the M×L matrix of filters needed for other approaches, since in most implementations L is much greater than M.

The processing savings introduced by the Technology 1, however, require that the acoustic transfer function between each loudspeaker and the acoustic pressure control points be representable with linear phase and frequency independent gains, for example, assuming a free-field point-monopole propagation model. However, it may be useful to use a more complex transfer function that would significantly improve the perceived quality of virtual sound images and that cannot be represented by simple gains and delays.

Overview of Technology 1

Sound-field control systems based on loudspeaker arrays aim to reproduce one or more acoustic signals at one or more points in space (control points), whilst simultaneously eliminating the acoustic cross-talk (or sound leakage) to other control points. Such acoustic control leads to the creation of narrow beams of sound that can be directionally controlled, or steered, in space in a precise manner to facilitate various acoustic applications.

Figure 3A:
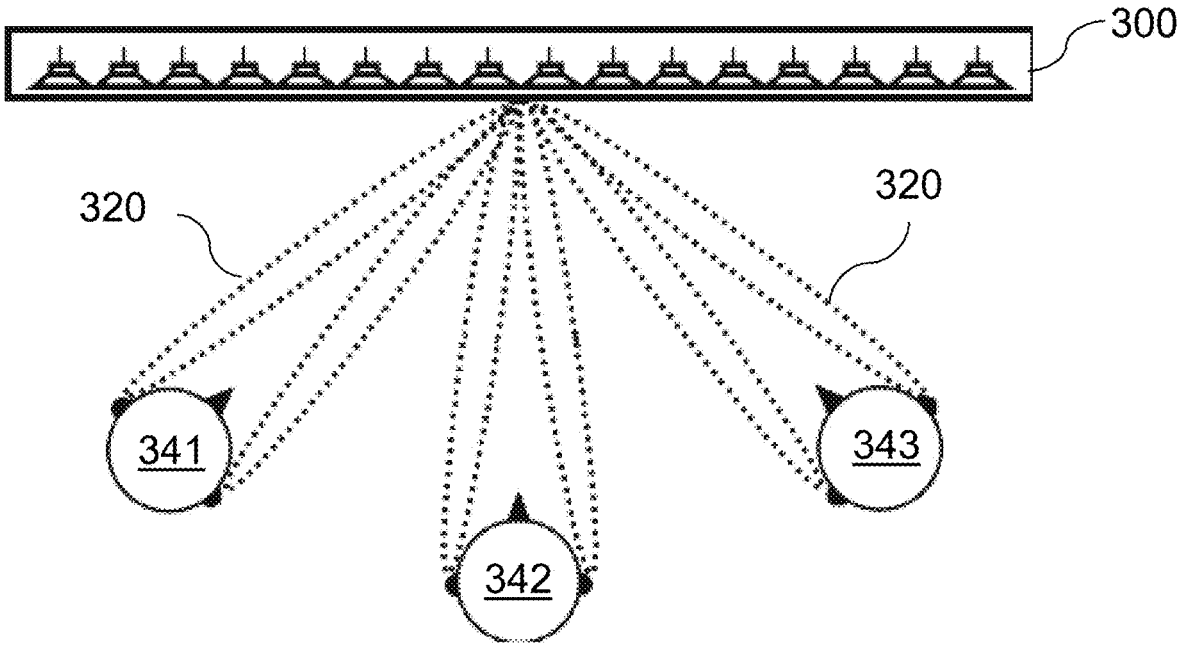
FIG. 3*a* illustrates a sound-field control application aimed at reproducing 3D binaural audio by performing cross-talk cancellation and creating narrow beams aimed at listeners' ears.
Figure 3B:
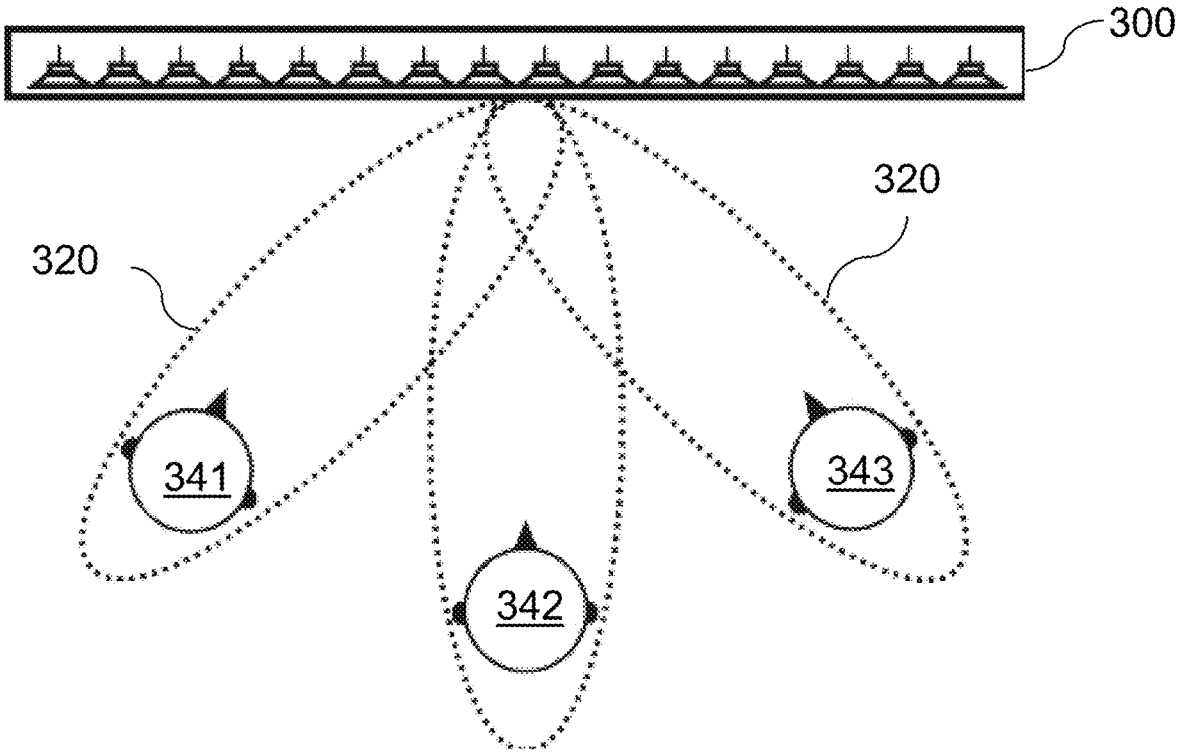
FIG. 3*b* illustrates a sound-field control application aimed at reproducing different content signals for different listeners.
Figure 3C:
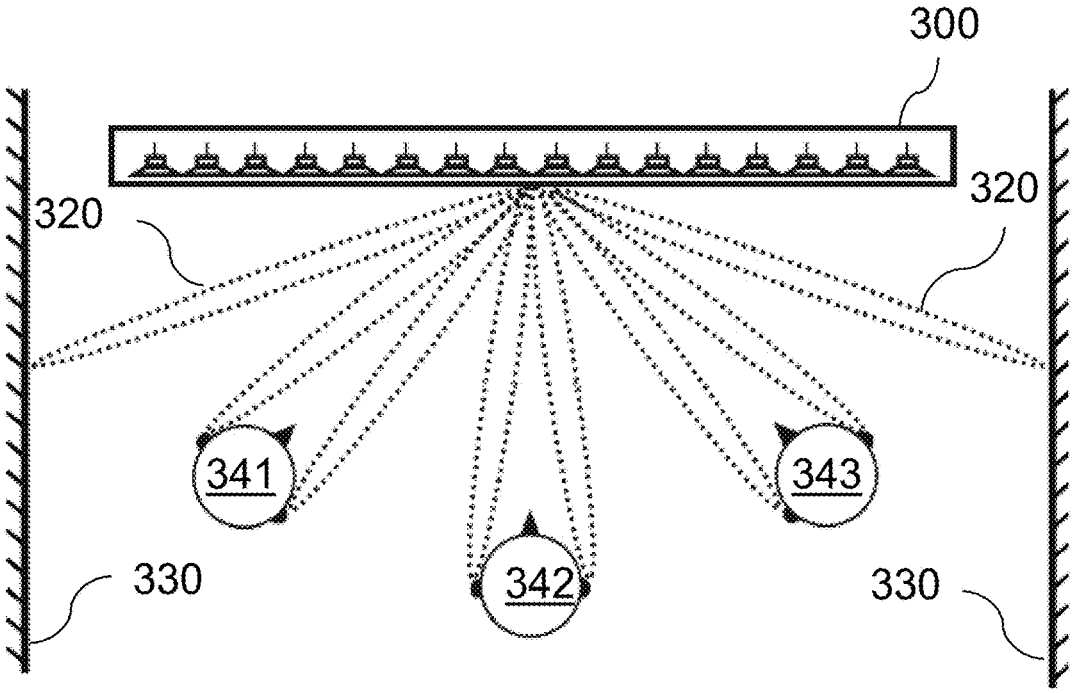
FIG. 3*c* illustrates a sound-field control application aiming to reproduce 3D binaural audio by performing cross-talk cancellation and creating narrow beams aimed at a plurality of listeners' ears whilst also bouncing sound off the environment's walls to create further 3D image sources.

For example, one application can accurately control the pressure to the ears of one or more listeners 341, 342, 343 to create 'virtual headphones' and reproduce 3D sound, which is known as cross-talk cancellation (CTC), as illustrated in FIG. 3*a*. Another application can be to reproduce various different and independent beams of sound 320 to two or more listeners, so that each of them can listen to a different sound program or to the same program with a user-specific sound level, as illustrated in FIG. 3*b*. As the beams of sound 320 control the sound field around the ears, these control techniques are known for the "ability to personalise sound around the listeners". Furthermore, the beams created by the loudspeaker array 300 can be controlled to also direct sound towards the walls 330 of the room where sound is reproduced. This sound bounces off the walls and reaches the listener(s), thus creating an immersive experience, as illustrated in FIG. 3*c*.

Figure 3D:
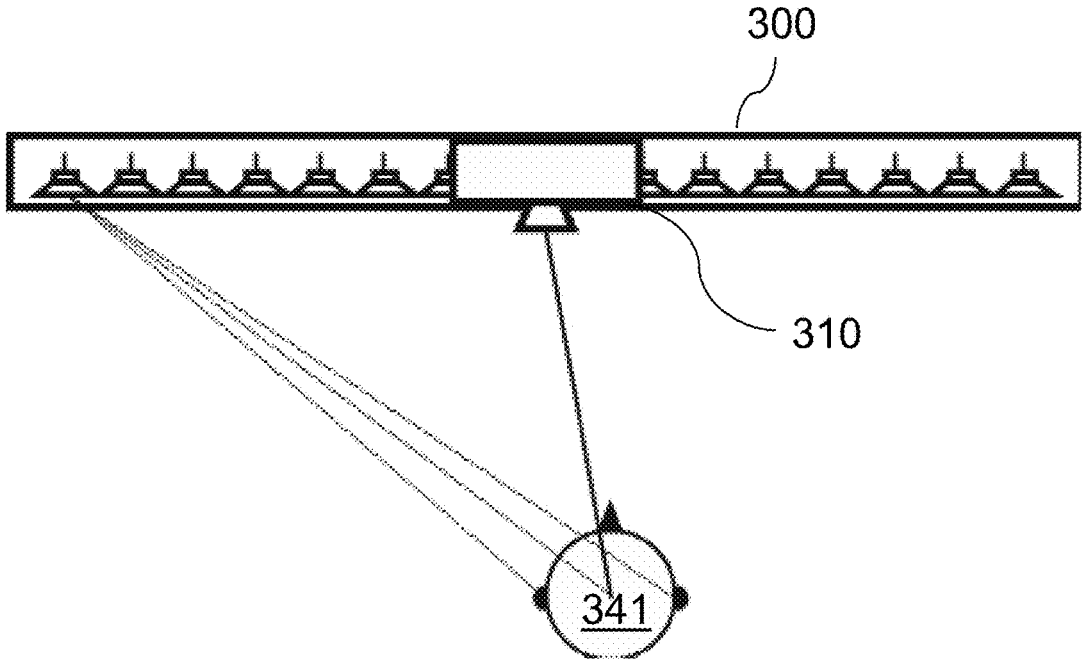
FIG. 3*d* illustrates the use of a head tracking system that estimates the real-time 3D position of a listener with respect to a loudspeaker array.

An L-channel loudspeaker array comprises loudspeakers located at positions $y_1, y_2, \ldots y_L \in \mathbb{R}$. For a given reproduction frequency $\omega=2\pi f$ in radians per second, the goal is to reproduce a set of M audio signals $d(\omega)=[d_1(\omega), \ldots, d_M(\omega)]^T$ that are rendered by M beams created by the loudspeaker array, at a set of control points $x_1, \ldots, x_M \in R^3$. The listener is free to move around in the listening space and the position of the control points $\{x_m\}$ can vary in space. To allow for this, the instantaneous spatial position of the control points $\{x_m\}$ may be gathered by a listener-tracking system 310 (camera, wearable, laser, sound-based) that provides the real-time coordinates of the listeners' ears with respect to each of the loudspeakers of the loudspeaker array, as shown in FIG. 3*d*.

Figure 4:
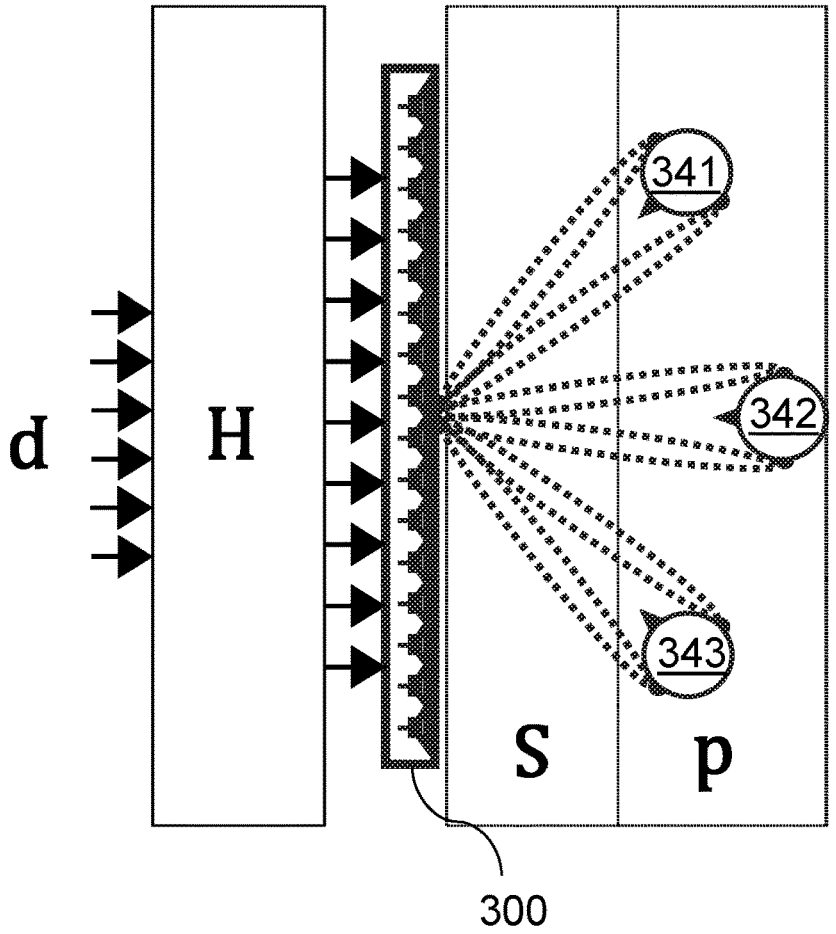
FIG. 4 shows a signal processing block diagram of an underlying acoustic control problem to reproduce a plurality of acoustic signals at a plurality of control points with a loudspeaker array.

A block diagram of the acoustic pressure control problem reproduced by a loudspeaker array is depicted in FIG. 4. The underlying acoustic control problem can be expressed in the frequency domain as $$p(\omega)=S(\omega)H(\omega)d(\omega), \tag{1}$$

where $p(\omega)=[p_1(\omega), \ldots, p_M(\omega)]^T$ contains the acoustic pressure signals reproduced at the different control points $x_m$, $(\cdot)^T$ denotes the vector or matrix transpose, $S(\omega)\in\mathbb{C}^{M\times L}$ is the so-called plant matrix whose elements are the acoustic transfer functions between the L sources and the M control points, and $H(\omega)\in\mathbb{R}^{L\times M}$ is the matrix of control filters designed to enable the reproduction of audio input signals $d(\omega)$ at the control points, given $S(\omega)$. Each column $h_m$ of H is designed to reproduce its corresponding audio signal $d_m$ at the control point $x_m$, whilst minimising the radiated pressure at the other control points. The dependence on $\omega$ will hereafter be omitted unless necessary.

Figure 5:
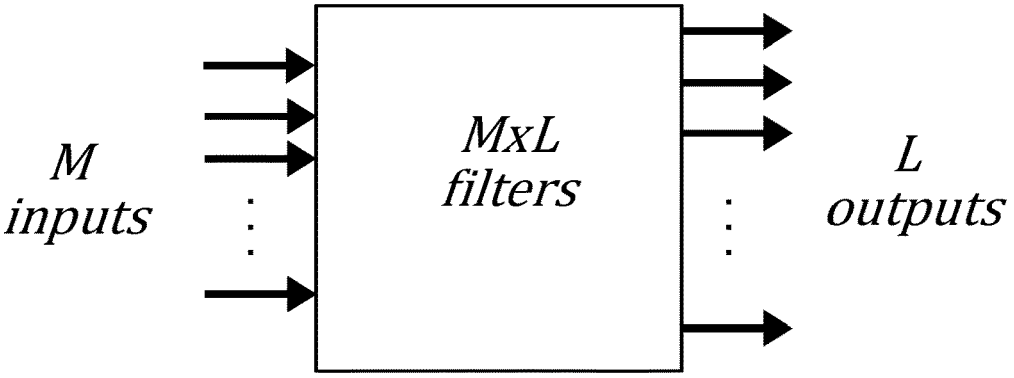
FIG. 5 shows a simplified signal processing diagram of a multiple input multiple output (MIMO) control process used in array signal processing to reproduce M input signals with L loudspeakers.

The final goal of the sound control system is to obtain $$p=e^{-j\omega T}d \tag{2}$$

where $j=\sqrt{-1}$ and $e^{-j\omega T}$ is a modelling delay used to ensure causality of the solution. This condition is satisfied if $SH=e^{-j\omega T}I$, where I is the M×M identity matrix. One approach that allows this condition to be approximately satisfied is to compute H as the regularised pseudoinverse matrix of S, namely $$H=e^{-j\omega T}S^H[SS^H+A]^{-1} \tag{3}$$

where A is a regularisation matrix and $(\cdot)^H$ denotes the Hermitian transpose. The above equation can be termed as the pseudoinverse solution for an undetermined system, and hence the set of control filters it returns can be referred to as "inverse" filters. Such a system will have M inputs for M audio signals and L outputs for the L loudspeakers of the array, as shown in the block diagram of FIG. 5. For the case of a MIMO system such as those used in classical array signal processing, M×L control filters are needed.

In array signal processing, the array control filters H are calculated for a given acoustic plant matrix, S. The plant matrix is a model of the electro-acoustic transfer functions between the array loudspeakers and the control points where the acoustic pressure is to be controlled. Ideally, the plant matrix will characterise the physical transfer function found in a practical acoustic system as accurately as possible. This is, however, not always possible in practical applications. Whilst it is possible to perform acoustic measurements and estimate the plant matrix of a given system with a relatively large degree of accuracy, this is a complex process that can only be accurately performed in laboratory conditions.

Furthermore, the plant matrix can change significantly even with small movements of the listener(s), which requires a dense grid of measurements to allow for a wide range of adaptability to listener movements. Moreover, this approach results in a set of L×M complex inverse filters, which causes a high computational complexity for reconstruction. It is therefore helpful to use very simple yet accurate models of acoustic propagation for representing the plant matrix S.

A particular case is when the plant matrix S is approximated by a simple matrix C that is formed assuming a free-field point-source acoustic propagation model between each of the loudspeakers and the acoustic pressure control points. Matrix C is therefore defined as $$C=\begin{bmatrix} c_1 \\ c_2 \\ \vdots \\ c_M \end{bmatrix}, \tag{4}$$

where each element of this matrix is formed by a delay and a gain element, e.g., $$c_m=\left[\frac{e^{-jkr_{m1}}}{r_{m1}}, \ldots, \frac{e^{-jkr_{mL}}}{r_{mL}}\right], \tag{5}$$

where $$k=\frac{\omega}{c_0}$$

is the wavenumber and $c_0$ the speed of sound in air and $r_{ml}$ is a frequency-independent real number that depends on the distance between the m-th acoustic control point and the acoustic centre of the l-th loudspeaker. Using such a propagation model allows for the elements of matrix C to be easily calculated once the positions of the control points are known with respect to the loudspeaker array, hence requiring modest processing for calculating a new set of control filters H.

Figure 6:
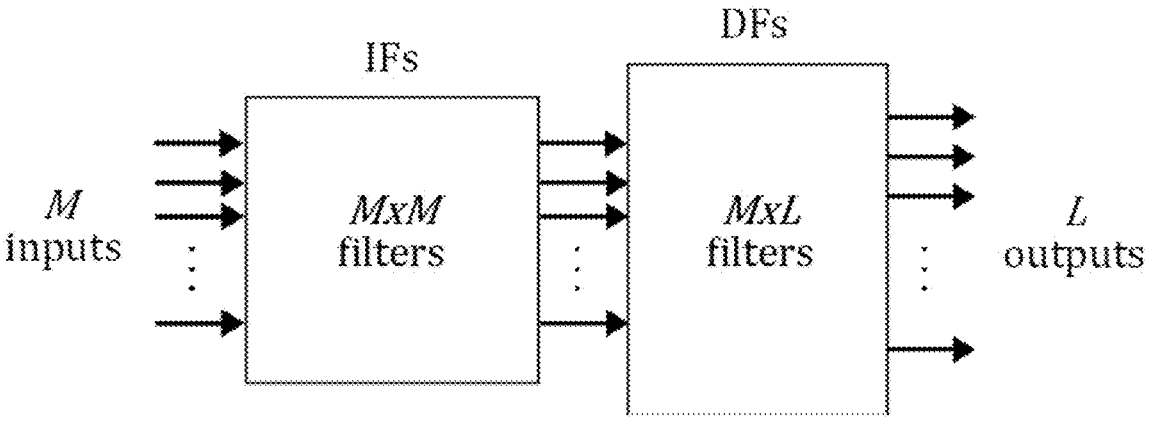
FIG. 6 shows a simplified signal processing diagram of a filtering approach referred to as 'Technology 1' to reproduce M input signals with L loudspeakers.
Figure 7:
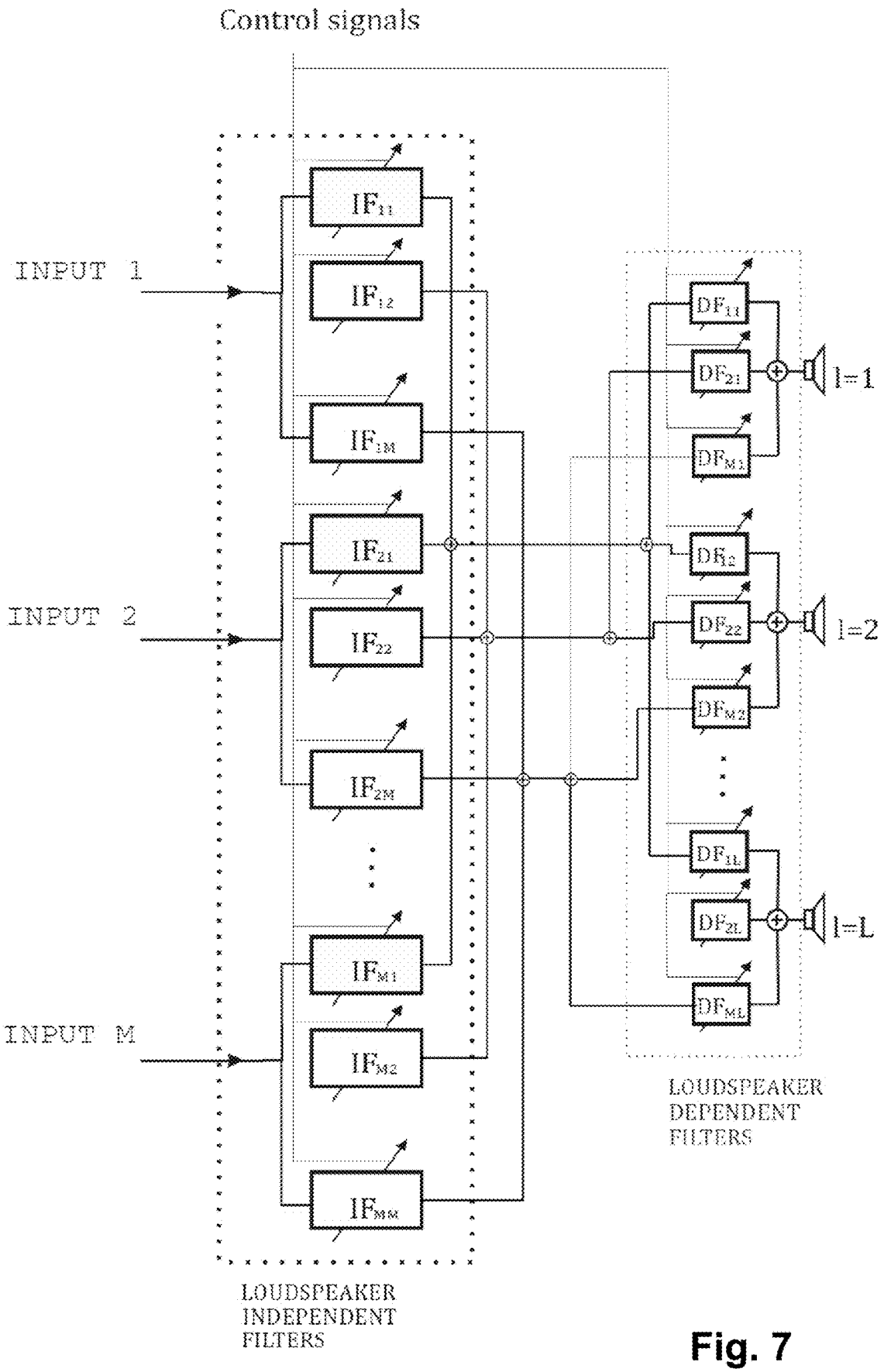
FIG. 7 shows an expanded signal processing diagram of the Technology 1 approach showing the M×M independent filters and M×L dependent filters.

Whilst using a simple electro-acoustic model is useful for reducing the amount of calculations needed to obtain a new set of filters, it is also useful to reduce the number of low-level operations required to filter a given amount of digital audio content. A further simplification can be carried out by analysing the structure of equation (3), which is the formula of the pseudoinverse of an underdetermined least-squares problem. Careful analysis shows that some terms (filter elements) are common to some of the outputs/loudspeakers. These are referred to as independent filters (IFs). Other terms are specific to only some of the loudspeakers and are referred to as dependent filters (DFs). The terms of equation (3), and therefore the resulting signal processing architecture, can therefore be grouped as follows:

$$H=\overbrace{e^{-j\omega T_1}C^H}^{DFs}\overbrace{e^{-j\omega T_2}[CC^H+A]^{-1}}^{IFs}. \tag{6}$$

where $T_1$ and $T_2$ are delays that satisfy the relation $T_1+T_2=T$. This makes it possible to break the signal processing in equation (6) into a set of M×M IFs and a set of L×M DFs. This leads to the signal processing scheme shown in FIG. 6, which is shown in its expanded form in FIG. 7.

One of the peculiarities of this array signal processing is that it is possible to implement the M×M IFs using conventional (time-varying) FIR filtering and the M×L DFs using M (time-variable) delay lines with L access points each. At this point, the DFs are acting like a delay-and-sum beamformer. When compared to a traditional MIMO filtering approach based on M×L variable filters, this implementation introduces a large reduction in the required computational cost needed to filter a certain amount of digital audio, thus allowing for a reduced number of floating point operations per second (FLOPS) and for the processing to be embedded in smaller devices. The only requirement to achieve this reduction in computation complexity is that the elements of matrix C include only frequency-independent gains and delays.

Technology 2 Approach

It may be useful to use more accurate, frequency-dependent transfer function models than those provided by the matrix C introduced above. For example, it may be desirable to use rigid-sphere or measured head related transfer functions (HRTFs) for cross-talk cancellation to account for the listeners' head diffraction and thus improve the spatial audio quality, or it may be useful to compensate for the loudspeakers' frequency response and directivity, or to compensate for the diffraction of other elements in the environment.

One way of achieving this is to substitute the simple matrix C with a more complex matrix G that provides a better approximation of the physical transfer function matrix S. Matrix G could, for example, be created by measuring the physical transfer function S, in which case the elements of G could be, for example, head-related transfer functions, or by using an analytical or numerical model of S, such as a rigid sphere or a boundary element model of a human head. However, in this case, the elements of G will not be simple delays and gains as in the case of C, but will be based on more complex frequency-dependent data or functions. If such a matrix G were to be used in equation (6) for the digital filter computation, this would, on the one hand, lead to better audio quality performance of the system but it would, on the other hand, require much more complex DFs, thus leading to a significant increase of the overall computational load.

The inventors have arrived at the insight that the audio quality of the Technology 1 can be significantly improved without significantly increasing computational load by using both a relatively complex, more accurate matrix G and a relatively simple, less accurate matrix C.

Firstly, it is recalled that, since the objective of the filter design step is $p=e^{-j\omega T}d$, where $p=SHd$, the filter H should be such that $$SH \approx e^{-j\omega T} I \tag{7}$$

where I is the M×M identity matrix.

Equation (6) for the calculation of H is substituted by (ignoring for the moment the regularisation matrix A)

$$H = \overbrace{e^{-j\omega T_1} C^H}^{DFs} \overbrace{e^{-j\omega T_2} [GC^H]^{-1}}^{IFs}. \tag{8}$$

$SC^H[GC^H]^{-1}$ provides a much better approximation to the identity matrix I than $SC^H[CC^H]^{-1}$ does since G is a much better approximation to S than C is. This allows for significantly improved audio quality.

The use of the more accurate but more computationally complex matrix G is, however, limited to the IFs, whereas the DFs are the simple gains and delays contained in matrix $e^{-j\omega T_1}C^H$. This allows for a much lower computational cost than would be required if matrix $G^H$ were also used for the DFs.

In this case, the forward problem of acoustic pressures is now given as $$p=e^{-j\omega T}SC^H[GC^H]^{-1}d. \tag{9}$$

Figure 8:
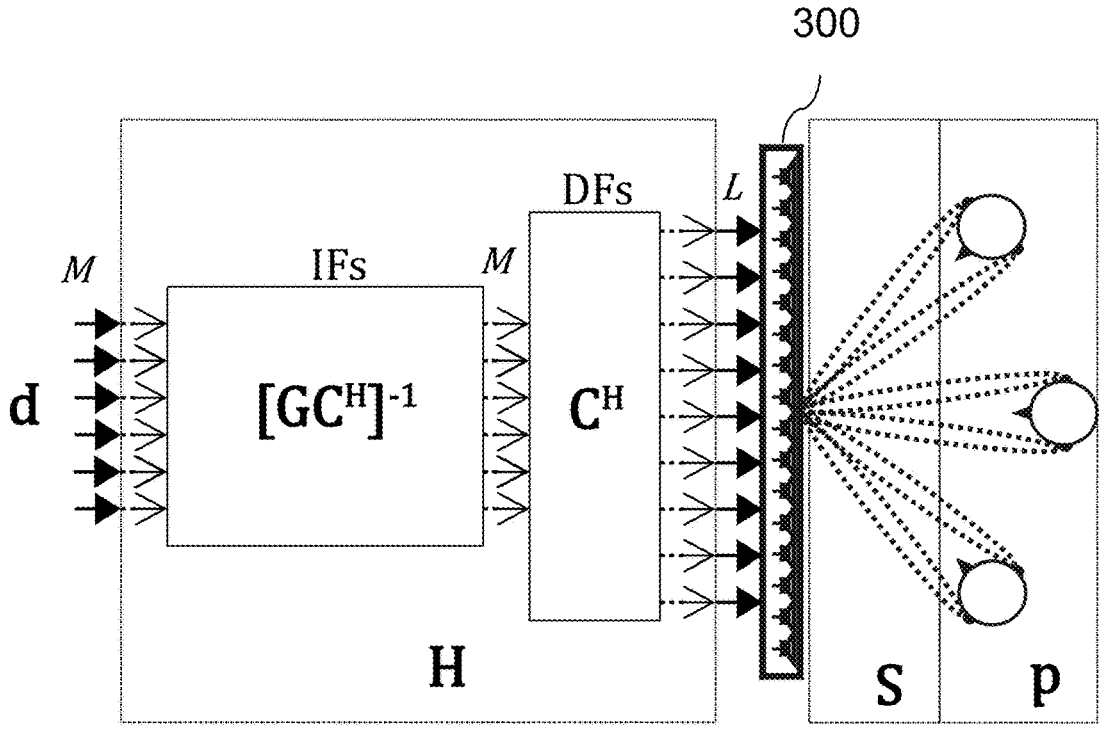
FIG. 8 shows a signal processing block diagram for an approach described herein, referred to as 'Technology 2'.

It is also possible to apply a regularisation scheme (e.g., Tikhonov regularisation) to the design of the IFs. In this case, equation (8) is rewritten as $$H=e^{-j\omega T}C^H[GC^H+A]^{-1} \tag{10}$$

where A is a regularisation matrix used to control the energy of the array filters. The block diagram corresponding to this digital signal processing (DSP) architecture is depicted in FIG. 8. It can be observed how the filters H can be divided into M×M independent filters IFs and M×L dependent filters DFs.

An alternative way to compute the independent filters IFs is to solve a (convex) optimisation problem $$\underset{IFs}{\operatorname{argmin}} \quad \|GC^H IFs - e^{-j\omega T} I\|_{p_1} \tag{11}$$

$$\text{subject to} \quad \|C^H IFs\|_{p_2} \le H_{max}. \tag{12}$$

Here $\|\cdot\|_{p1}$ and $\|\cdot\|_{p2}$ represent suitable matrix norms, for example the Frobenius norm, and $H_{max}$ is an upper admissible limit on the norm of the matrix of array filters H.

It is worth noting at this point that the combinations of the matrices G and C offer other possibilities to create array control filters which may benefit from the use of this hybrid control approach and a more realistic transfer function model. For example, it may be useful to employ "weighted" control approaches to adjust the contribution from any chosen loudspeaker to control the acoustic pressure at any of the control points, by computing H as $$H=e^{-j\omega T}W_L C^H[GW_L C^H+A]^{-1}, \tag{13}$$

where in this case $W_L$ is an L×L diagonal weighting matrix containing positive weights for each loudspeaker.

A similar approach can be useful for some of the use cases where one wishes to control the acoustic pressure at each of the control points in a different manner. In this case, a matrix $W_M$ with size M×M containing positive weights can be used, where the control filters are given by:

$$H=[GW_M C^H+A]^{-1}C^H W_M e^{-j\omega T}. \tag{14}$$

The following set of terms are now defined:

The elements of the newly-introduced matrix G, i.e., $G_{m,l}$, have the form $G_{m,l}=G_0(x_m,y_l,\omega)e^{-j\omega\tau(x_m,y_l)}$, where $\tau(x_m, y_l)$ is a position dependent delay that depends on the position of each loudspeaker and control point and $G_0(x_m,y_l,\omega)$ is a complex frequency dependent function.

The elements of C, i.e., $C_{m,l}$, are formed by gains and delays of the form $C_{m,l}=e^{-j\omega\tau(x_m,y_l)}g_{m,l}$.

The real-valued gains $g_{m,l}$ depend on the relative position of the loudspeakers and control points.

The delay term $\tau(x_m,y_l)$ included in the definition of $G_{m,l}$ may be the same delay that defines the corresponding element $C_{m,l}$ of matrix C.

The delay term $\tau(x_m,y_l)$ can be chosen in such a way that the phase of the terms on the diagonal of matrix $GC^H$ is as close to zero as possible.

Hence, a possible choice of the delay is the value $\tau(x_m,y_l)$ such that $\omega\tau(x_m,y_l)$ is the best linear approximation (across frequency) of the phase of $G_{m,l}$.

Other possibilities for the design of C are based on the collinearity factor $$\gamma_{m,m'} = \frac{|g_m \cdot c_{m'}{}^H|}{\|g_m\| \, \|c_{m'}\|} \tag{15}$$

where $\|\cdot\|$ is the $\ell^2$ norm operator and $c_{m'}$ and $g_m$ are the m'-th row of matrix C and the m-th row of matrix G, respectively.

One option is to choose the delay terms $\tau(x_m,y_l)$ and the gain terms $g_{m,l}$ in such a way that the collinearity factor $\gamma_{m,m'}$ is maximised (or increased) for each combination of rows with indices m=m', over a frequency range of interest.

Another possibility is to choose the delay terms $\tau(x_m,y_l)$ and the gain terms $g_{m,l}$ in such a way that an optimal trade-off is achieved between maximising (or increasing) the collinearity factor for each combination of rows with indices m=m' and minimising (or reducing) the collinearity factor for rows with indices m≠m', again over a frequency range of interest.

As an example, one possible mathematical formulation of this optimisation problem is $$\underset{\mathcal{T},\mathcal{G}}{\operatorname{argmax}} \sum_{k=1}^{K} \zeta_k \sum_{m=1}^{M} \left[ \gamma_{m,m}(\omega_k) - \alpha_k \sum_{m' \neq m} \gamma_{m,m'}(\omega_k) \right] \tag{16}$$

where the design parameters $\alpha_k$ and $\zeta_k$ are non-negative real numbers and $\mathcal{T}$ and $\mathcal{G}$ are the sets of all delays $\tau(x_m,y_l)$ and gains $g_{m,\ell}$, respectively. $\{w_k\}_{k=1,\ldots,K}$ is a set of frequencies spanning the frequency range of interest (note that $\gamma_{m,m'}$ is a frequency-dependent quantity).

One of the advantages of this optimisation approach is that it increases the stability of the system. For the case when M=2, this is demonstrated by the fact the absolute value of $\det(GC^H)$, the determinant of the matrix to be inverted for the filter computation, is $$\begin{aligned} |\det(GC^H)| &= |(c_1^H g_1)(c_2^H g_2) - (c_1^H g_2)(c_2^H g_1)| \\ &= \|c_1\| \, \|c_2\| \, \|g_1\| \, \|g_2\| \, |\gamma_{1,1}\gamma_{2,2} - \gamma_{2,1}\gamma_{1,2}e^{j\phi}| \\ &\geq \|c_1\| \, \|c_2\| \, \|g_1\| \, \|g_2\| \, |\gamma_{1,1}\gamma_{2,2} - \gamma_{2,1}\gamma_{1,2}| \end{aligned} \tag{17}$$

where $\phi$ is a phase term. It can be seen that, if no assumption is made with regard to $\phi$, maximising (or increasing) $\gamma_{1,1}$ and $\gamma_{2,2}$ and minimising (or reducing) $\gamma_{1,2}$ and $\gamma_{2,1}$ maximises (or increases) the absolute value of the determinant and therefore increases the system stability.

The above approaches use two sets of transfer functions to calculate array filters, and are referred to as 'Technology 2'.

Filter Bank Implementation

For certain applications, it may be useful to implement parallel versions of the same signal processing algorithm but for different frequency bands. This could be needed, for example, if different types of acoustic actuators are used for different frequency ranges (tweeters and woofers). In this case, different number of loudspeakers $L_n$ could be used for each different band. This requires matrices C and G to be computed differently for different frequency bands so that the elements of these matrices can take different values for n=[1, . . . , N] different frequency bands. Three different approaches to achieve this are described in the following.

Figure 9C:
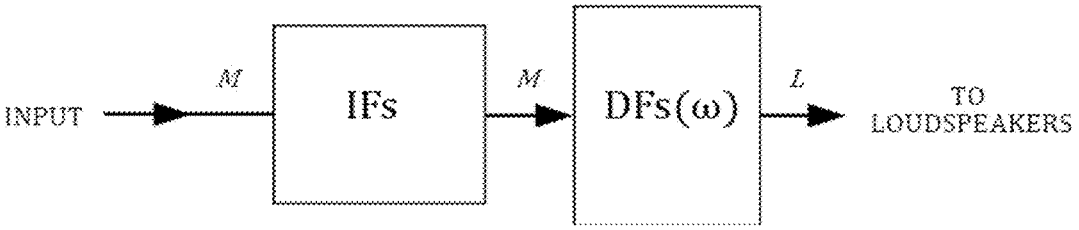
FIG. 9*c* illustrates a third signal processing scheme dividing the Technology 2 process into multiple frequency bands.
Figure 9A:
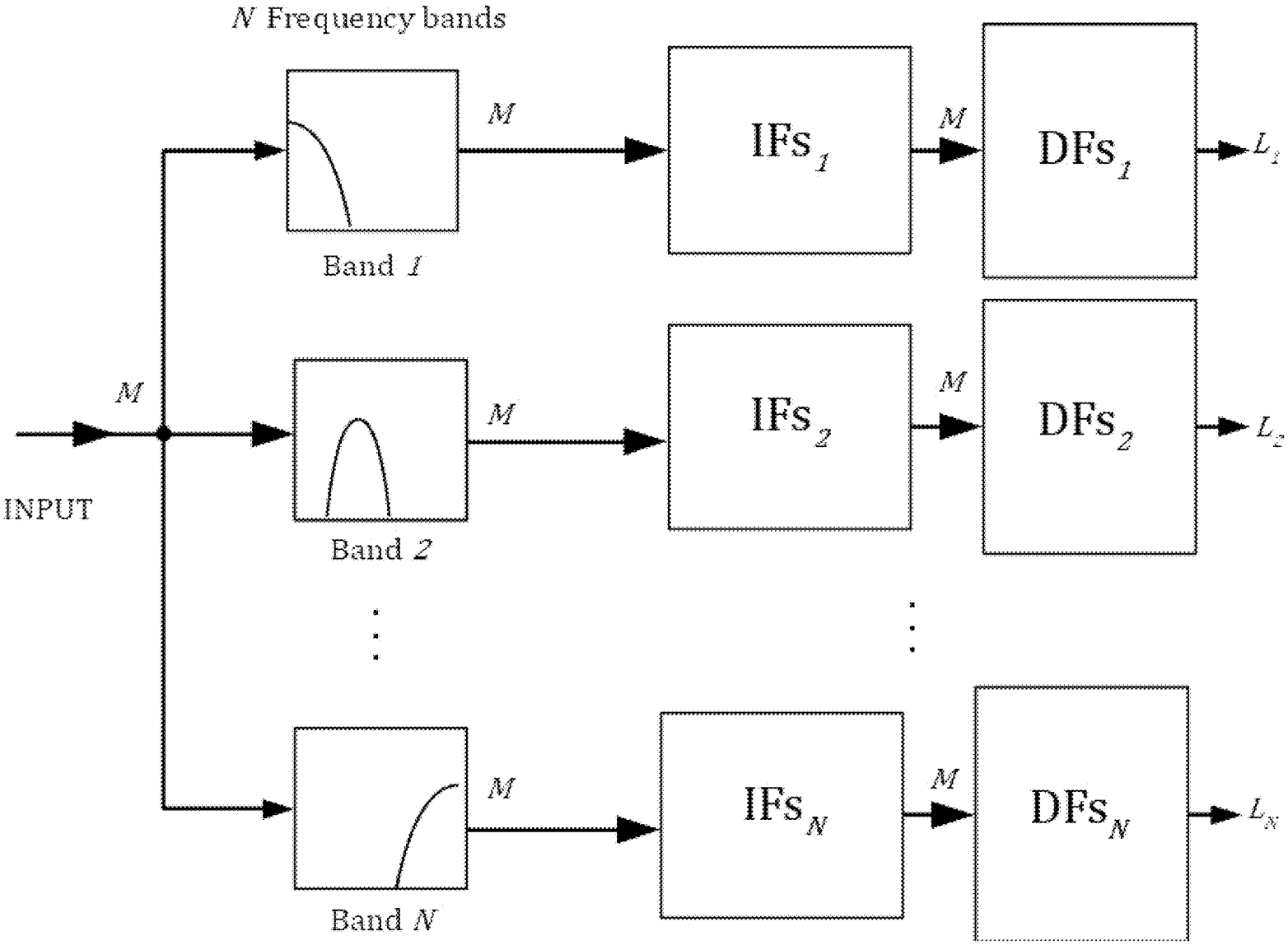
FIG. 9*a* illustrates a first signal processing scheme dividing the Technology 2 process into multiple frequency bands to allow for the signal processing parameters to take different values in different frequency bands.

The first multi-band architecture is shown in FIG. 9*a*. A set of N band-pass filters $B_n$ is used at the input and the core Technology 2 processing is duplicated N times. In this case, the IFs and DFs are different for each frequency band. The band-pass filters can alternatively be low-pass filters or high-pass filters. In this case the IFs and DFs for the n-th frequency band can be defined as $$IF_n = [G_n C_n^H + A_n]^{-1} \tag{18}$$

$$DF_n = C_n \tag{19}$$

where the matrices $G_n$, $C_n$, $A_n$ are as defined above in this document, but with parameter values specific for the n-th frequency band. With these definitions of IFs and DFs, the $L_n$ loudspeaker signals $q_n$ corresponding to the n-th frequency band are given, in the frequency domain, by $$q_n = C_n^H [G_n C_n^H + A_n]^{-1} B_n d \tag{20}$$

Figure 9B:
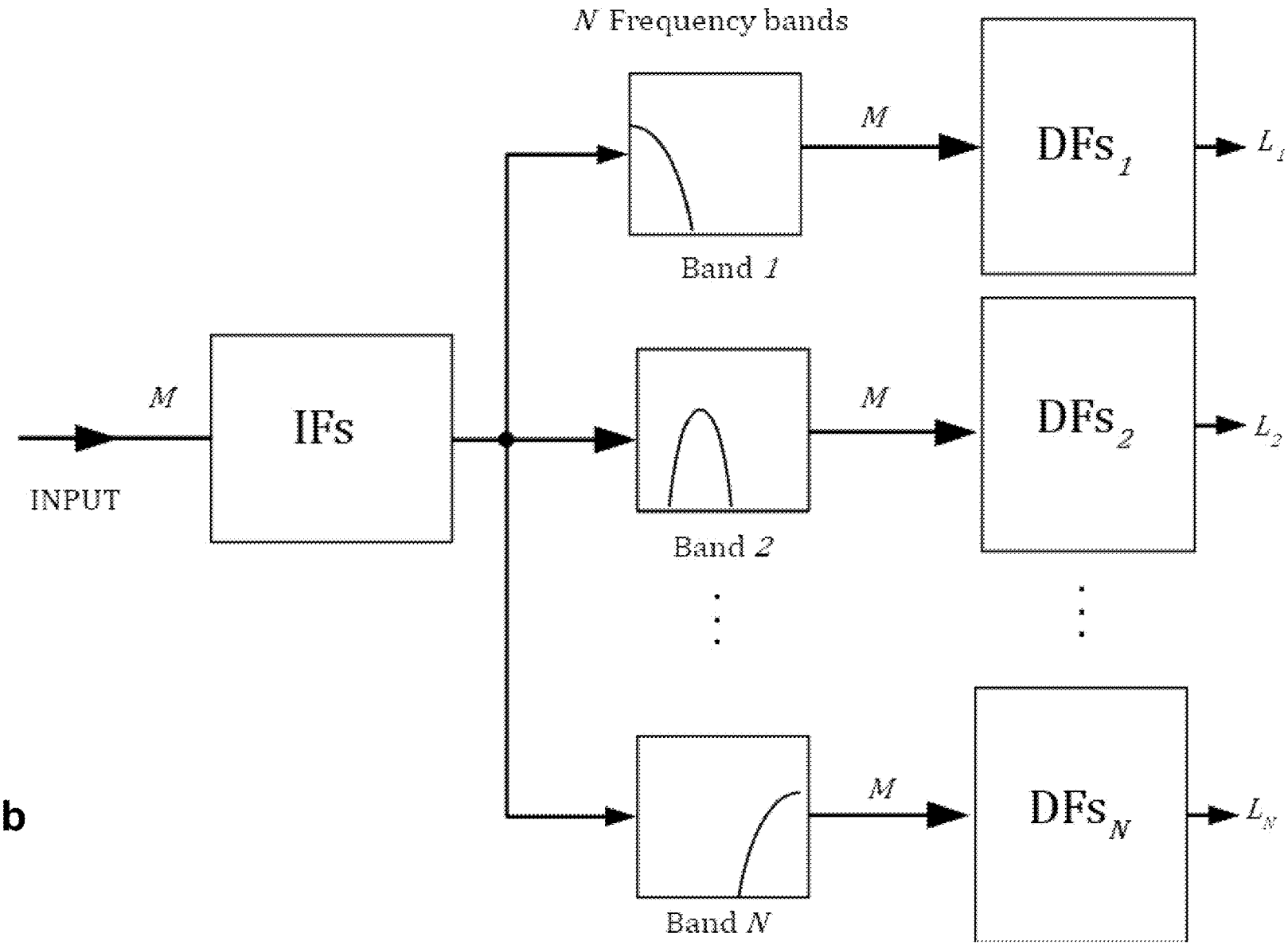
FIG. 9*b* illustrates a second signal processing scheme dividing the Technology 2 process into multiple frequency bands.

A second possible multi-band DSP architecture is shown in FIG. 9*b*. In this case, the IFs take into account the various delays in matrices $C_n$, different for each frequency band, and the output of the IFs are later divided into N frequency bands that are fed to N sets of DFs with different values of the scaled delay for each frequency band. This scheme requires the use of only M×M IFs, as opposed to having a different set of IFs for each frequency band. These IFs can be defined as $$IF = \sum_{n=1}^{N} W_n [G_n C_n^H + A_n]^{-1} \tag{21}$$

where $W_n$ is a frequency weighting function that depends primarily on the band-pass filters $B_n$ and may be complex-valued. The DFs can be computed as in equation (19).

A third possible multi-band DSP architecture is shown in FIG. 9*c*. In this case the multi-band processing is included in both the IFs and DFs, so that a single set of M×M IFs and M×L DFs is required (as opposed to one different set for each frequency band). The IFs can be defined as in equation (21), whereas the DFs can be defined as $$DF = \sum_{n=1}^{N} B_n C_n^H \tag{22}$$

With this approach, the DFs are no longer gain-delay elements. In this third approach, the signals related to the various frequency bands are summed together, for each given loudspeaker. Hence this method is not suitable in cases where different acoustic drivers are used for different frequency bands (tweeter and woofer). There are, however, other applications where this approach can be useful, for example when the group delays of the elements of G are better approximated by different delays in different frequency bands. With the definitions of IFs and DFs above, the L loudspeaker signals q are given, in the frequency domain, by $$q = \left[\sum_{n=1}^{N} B_n C_n^H\right]\left[\sum_{m=1}^{N} W_m (G_m C_m^H + A_m)^{-1}\right] d \tag{23}$$

Effects of Technology 1 and Technology 2 Approaches

Figure 10A:
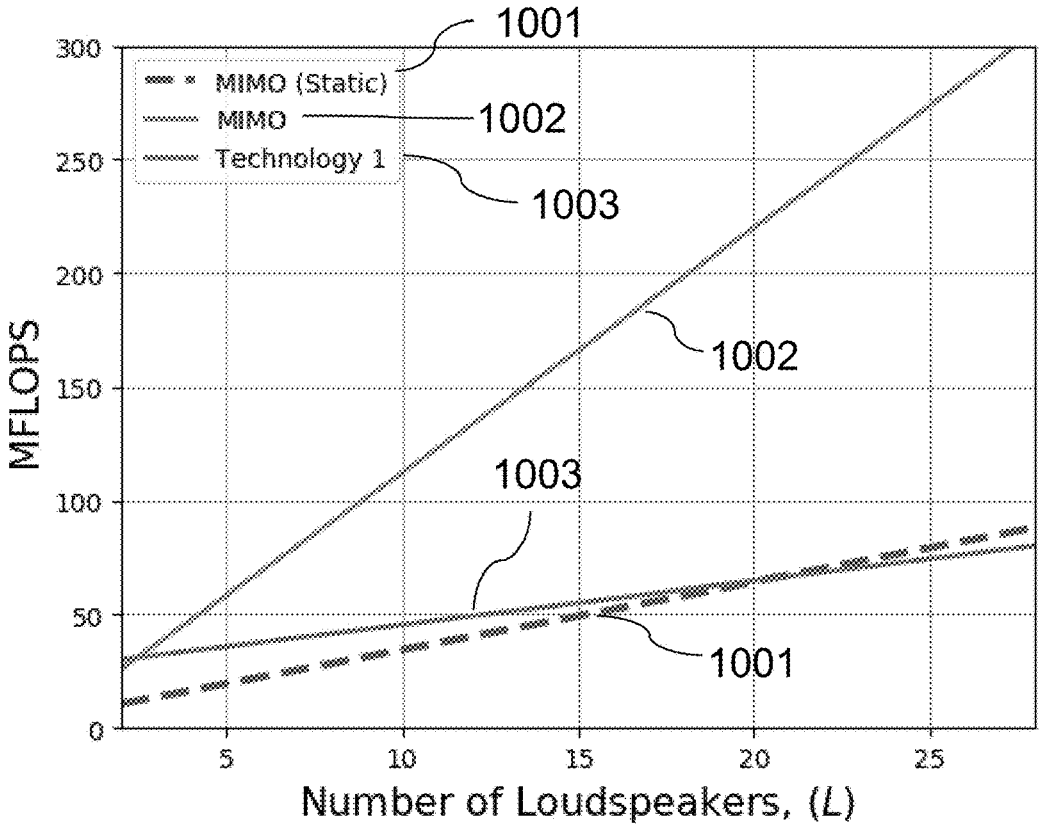
FIG. 10*a* shows results of a simulation of processing power requirements for listener-adaptive array filters based on the Technology 1 approach compared with traditional listener-adaptive and static MIMO approaches.

FIG. 10*a* shows results of a simulation of processing power requirements for listener-adaptive array filters based on the Technology 1 approach compared with traditional listener-adaptive and static MIMO approaches. Specifically, the number of MFLOPS required as a function of the number of loudspeakers L is shown for a static MIMO approach 1001, a listener-adaptive MIMO approach 1002, and the Technology 1 approach 1003.

Figure 10B:
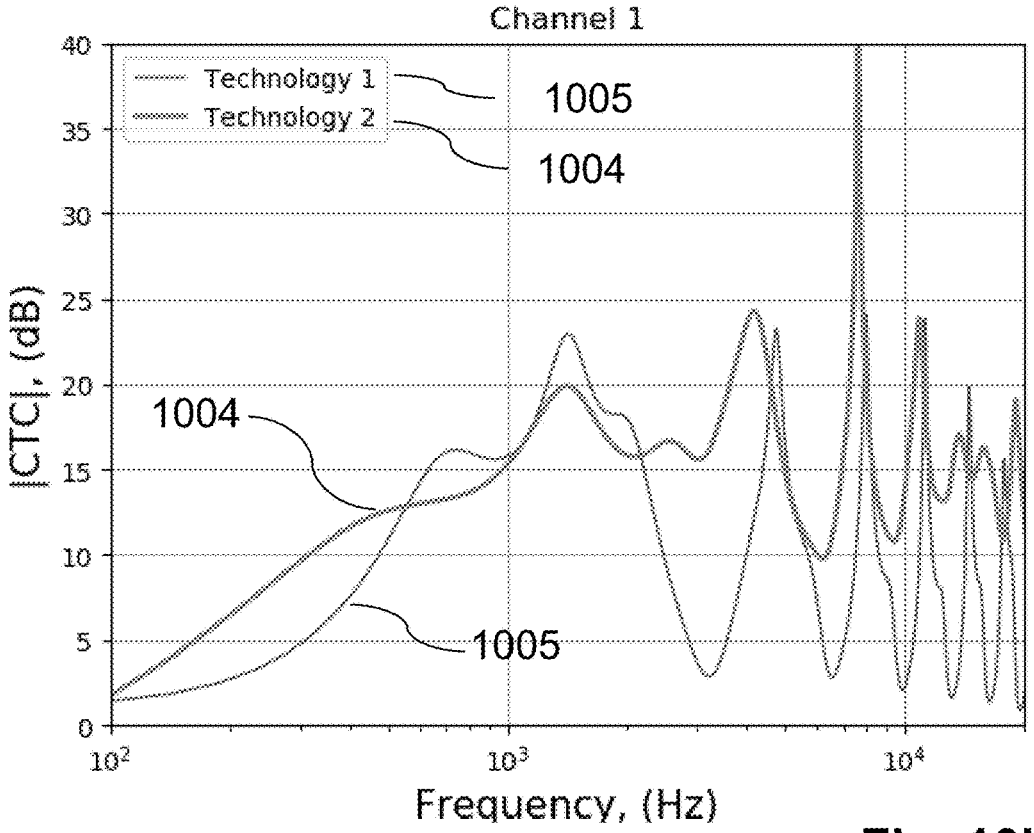
FIG. 10*b* shows a comparison of cross-talk cancellation performance between filters obtained using the Technology 1 approach and the Technology 2 approach described herein.

To illustrate the advantage that the Technology 2 approach provides, the results of a simulation are shown in FIG. 10*b* for a loudspeaker array with three loudspeakers. In this simulation, the CTC spectrum is shown, representing the channel separation of the acoustic signals delivered at the ears of a listener. This performance metric should ideally be as large as possible for an array delivering 3D sound through CTC to provide good 3D immersion. As observed in FIG. 10*b*, the performance of Technology 2 1004 is much better than that of Technology 1 1005 along the audio frequency range, particularly above 2 kHz, where the effects of head diffraction are large.

The Technology 2 approach combines the simplicity and low computational cost of the Technology 1, because of the presence of simple DFs represented by matrix $C^H$, but it also allows for the introduction of a more accurate plant matrix G in the calculation of the IFs, without a significant increase of the overall computational cost of the algorithm. This allows complex acoustical phenomena (such as diffraction due to the head or reflections by the acoustic environment) to be taken into account and compensated for, and thereby improve the quality of the reproduced audio.

An effect of the present disclosure is to provide a filter calculation scheme that allows for the use of complex transfer function models whilst using a limited amount of processing resources.

An effect of the present disclosure is to provide a filtering approach with improved stability.

Alternative Implementations

It will be appreciated that the above approaches, and in particular Technology 1 and Technology 2, can be implemented in many ways. There follows a general description of features which may be common to many implementations of the above approaches. It will of course be understood that, unless indicated otherwise, any of the features of the above approaches may be combined with any of the common features listed below.

There is provided a method of controlling (or 'driving') an array of loudspeakers (e.g., a line array of L loudspeakers).

The method may comprise receiving a plurality of input audio signals to be reproduced (e.g., d), by the array, at a respective plurality of control points (or 'listening positions') (e.g., $x_1, \ldots, x_M \in R^3$) in an acoustic environment (or 'acoustic space').

Each of the plurality of input audio signals may be different.

At least one of the plurality of input audio signals may be different from at least one other one of the plurality of input audio signals.

The method may further comprise generating (or 'determining') a respective output audio signal (e.g., Hd or q) for each of the loudspeakers in the array by applying a set of filters (e.g., H) to the plurality of input audio signals (e.g., d).

The set of filters may be digital filters. The set of filters may be applied in the frequency domain.

The set of filters may be based on a first plurality of filter elements (e.g., C) and a second plurality of filter elements (e.g., G).

The first plurality of filter elements (e.g., C) may be based on a first approximation of a set of transfer functions (e.g., S).

The second plurality of filter elements (e.g., G) may be based on a second approximation of the set of transfer functions (e.g., S).

Each transfer function in the set of transfer functions may be between an audio signal applied to a respective one of the loudspeakers and an audio signal received at a respective one of the control points from the respective one of the loudspeakers.

The first and second pluralities of filter elements may be based on different approximations of the set of transfer functions. In particular, the different approximations may be based on different models of the set of transfer functions.

A filter element may be a weight of a filter. A plurality of filter elements may be any set of filter weights. A filter element may be any component of a weight of a filter. A plurality of filter elements may be a plurality of components of respective weights of a filter.

The set of filters may be obtained by combining two different matrices, C and G, which are in turn calculated using two different approximations of the physical electro-acoustical transfer functions that constitute the system plant matrix S. Matrix G (e.g., as used in equation 10) may be formed using an accurate, frequency-dependent approximation of the plant matrix S. Matrix C (e.g., as used in equation 10) may be formed using frequency-independent gains and delays or, more generally, elements that are different from the elements of G and allow for DFs that can be computed with a reduced computational load compared to DFs that are computed based on G.

The first approximation (e.g., that used to determine C) may be based on a free-field acoustic propagation model and/or a point-source acoustic propagation model.

The second approximation (e.g., that used to determine G) may account for one or more of reflection, refraction, diffraction or scattering of sound in the acoustic environment. The second approximation may alternatively or additionally account for scattering from a head of one or more listeners. The second approximation may alternatively or additionally account for one or more of a frequency response of each of the loudspeakers or a directivity pattern of each of the loudspeakers.

The set of filters (e.g., H) may comprise:

a first subset of filters (e.g., $[GC^H]^{-1}$) based on the first (e.g., C) and second (e.g., G) pluralities of filter elements; and a second subset of filters (e.g., $C^H$) based on one of the first or second pluralities of filter elements.

Generating the respective output audio signal for each of the loudspeakers in the array may comprise:

generating a respective intermediate audio signal for each of the control points (m) by applying the or a first subset of filters (e.g., $[GC^H]^{-1}$) to the input audio signals (e.g., d); and generating the respective output audio signal for each of the loudspeakers by applying the or a second subset of filters (e.g., $C^H$) to the intermediate audio signals.

The array may comprise L loudspeakers and the plurality of control points may comprise M control points, and the first subset of filters may comprise $M^2$ filters and the second subset of filters may comprise L×M filters.

The set of filters or the first subset of filters may be determined based on an inverse of a matrix (e.g., $[GC^H]$) containing the first (e.g., C) and second (e.g., G) pluralities of filter elements.

The matrix (e.g., $[GC^H]$) containing the first and second pluralities of filter elements may be regularised prior to being inverted (e.g., by regularisation matrix A).

The matrix (e.g., $[GC^H]$) containing the first and second pluralities of filter elements may be determined based on:

in the frequency domain, a product of a matrix (e.g., G) containing the second plurality of filter elements and a matrix (e.g., $[C^H]$) containing the first plurality of filter elements; or an equivalent operation in the time domain.

The set of filters may be determined based on:

in the frequency domain, a product of a matrix (e.g., $[C^H]$) containing the first plurality of filter elements and the inverse of the matrix (e.g., $[GC^H]$) containing the first and second pluralities of filter elements; or an equivalent operation in the time domain.

The set of filters may be determined using an optimisation technique.

The first subset of filters may be determined so as to reduce a difference between a scalar matrix (e.g., an identity matrix I) and a matrix comprising a product of: a matrix (e.g., G) comprising the second plurality of filter elements, a matrix (e.g., C) comprising the first plurality of filter elements, and a matrix representing the first subset of filters (e.g., IFs).

Each one of the first plurality of filter elements (e.g., C) may be a frequency-independent delay-gain element (e.g., $C_{m,l}=e^{-j\omega\tau(m,y_l)}g_{m,l}$).

Each one of the first plurality of filter elements may comprise a delay term (e.g. $e^{-j\omega\tau(x_m,y_l)}$) and/or a gain term (e.g., $g_{m,l}$) that is based on a relative position (e.g., $x_m$) of one of the control points and one of the loudspeakers (e.g. $y_l$).

For each given one (m) of the plurality of control points:

a first vector (e.g., $c_m$) may contain the filter elements from the first plurality of filter elements (e.g., C) that correspond to the given control point (m), and a second vector (e.g., $g_m$) may contain the filter elements from the second plurality of filter elements (e.g., G) that correspond to the given control point (m);

and each one of the first plurality of filter elements may comprise a delay term and/or a gain term that is determined based on a collinearity (e.g., γ) between the first and second vectors.

The delay term (e.g. $e^{-j\omega\tau(x_m,y_l)}$) and/or the gain term (e.g., $g_{m,l}$) may be determined so as to increase (or maximise), for each given one (m) of the plurality of control points, the collinearity (e.g., $\gamma_{m,m'}$) between the first vector (e.g., $c_m$) corresponding to the given control point and the second vector (e.g., $g_m$) corresponding to the given control point.

The delay term (e.g. $e^{-j\omega\tau(x_m,y_l)}$) and/or the gain term (e.g., $g_{m,l}$) may be determined so as to:

reduce (or minimise), for each pair of different first ($m_1$) and second ($m_2$) given ones of the plurality of control points, the collinearity (e.g., $\gamma_{m_1,m_2}$) between the first vector (e.g., $c_{m_1}$) corresponding to the first given control point and the second vector (e.g., $g_{m_2}$) corresponding to the second given control point; and increase (or maximise), for each third given one ($m_3$) of the plurality of control points, the collinearity (e.g., $\gamma_{m_3,m_3}$) between the first vector (e.g., $c_{m_3}$) corresponding to the third given control point and the second vector (e.g., $g_{m_3}$) corresponding to the third given control point.

Each one of the first plurality of filter elements may comprise a delay term (e.g. $e^{-j\omega\tau(x_m,y_l)}$) and/or a gain term (e.g., $g_{m,l}$) that is determined, for each given row of a first matrix (e.g., C) comprising the first plurality of filter elements, so as to:

increase (or maximise) a collinearity (e.g., γ) between the given row of the first matrix (e.g., C) and a corresponding row of a second matrix (e.g., G) comprising the second plurality of filter elements; and optionally, reduce (or minimise) the collinearity (e.g., γ) between the given row of the first matrix (e.g., C) and non-corresponding rows of the second matrix (e.g., G).

Each one of the first plurality of filter elements may comprise a delay term (e.g. $e^{-j\omega\tau(x_m,y_l)}$) based on a linear approximation of a phase of a corresponding one of the second plurality of filter elements (e.g., G).

The plurality of control points (e.g., $x_1, \ldots, x_M \in R^3$) may comprise locations of a corresponding plurality of listeners, e.g., when operating in a 'personal audio' mode.

The plurality of control points (e.g., $x_1, \ldots, x_M \in R^3$) may comprise locations of ears of one or more listeners, e.g., when operating in a 'binaural' mode.

The second approximation may be based on one or more head-related transfer functions, HRTFs. The one or more HRTFs may be measured HRTFs. The one or more HRTFs may be simulated HRTFs. The one or more HRTFs may be determined using a boundary element model of a head.

The second plurality of filter elements may be determined by measuring the set of transfer functions.

The method may further comprise determining the plurality of control points using a position sensor.

Generating the respective output audio signals (e.g., Hd) may comprise using a filter bank to apply at least a portion of the set of filters in a plurality of frequency subbands.

The first subset of filters (e.g., $[GC^H]^{-1}$) and the second subset of filters (e.g., $C^H$) may be applied in each of the frequency subbands (e.g., as illustrated in FIG. 9*a*).

The first subset of filters (e.g., $[GC^H]^{-1}$) and the second subset of filters (e.g., $C^H$) may be applied within the filter bank (e.g., as illustrated in FIG. 9*a*).

The first subset of filters (e.g., $[GC^H]^{-1}$) may be applied in fullband and the second subset of filters (e.g., $C^H$) may be applied in each of the frequency subbands (e.g., as illustrated in FIG. 9*b*). In other words, the first subset of filters (e.g., $[GC^H]^{-1}$) may be applied outside the filter bank and the second subset of filters (e.g., $C^H$) may be applied within the filter bank.

Generating a respective output audio signal for each of the loudspeakers in the array may comprise:

generating, for each of a first subset of the loudspeakers, a respective output audio signal in a first one of the plurality of frequency subbands; and generating, for each of a second subset of the loudspeakers, a respective output audio signal in a second one of the plurality of frequency subbands, the first and second subsets of the loudspeakers being different and the first and second ones of the plurality of frequency subbands being different.

The first plurality of filter elements may comprise a first subset of first filter elements for a first one of the plurality of frequency subbands and a second subset of first filter elements for a second one of the plurality of frequency subbands; and/or the second plurality of filter elements may comprise a first subset of second filter elements for the first one of the plurality of frequency subbands and a second subset of second filter elements for the second one of the plurality of frequency subbands.

The first subset of first filter elements and the second subset of first filter elements may be different and/or the first subset of second filter elements and the second subset of second filter elements may be different.

The set of filters (e.g., H) may be time-varying. Alternatively, the set of filters (e.g., H) may be fixed or time-invariant, e.g., when listener positions and head orientations are considered to be relatively static.

The method may further comprise outputting the output audio signals (e.g., Hd or q) to the loudspeaker array.

The method may further comprise receiving the set of filters (e.g., H), e.g., from another processing device, or from a filter determining module. The method may further comprise determining the set of filters (e.g., H).

The first and second approximations may be different.

At least one of the first plurality of filter elements (e.g., C) may be different from a corresponding one of the second plurality of filter elements (e.g., G).

The method may further comprise determining any of the variables listed herein using any of the equations set out herein.

The set of filters may be determined using any of the equations set out herein (e.g., equations 6, 8, 10, 13, 14).

There is provided an apparatus configured to perform any of the methods described herein.

The apparatus may comprise a digital signal processor configured to perform any of the methods described herein.

The apparatus may comprise the loudspeaker array.

The apparatus may be coupled, or may be configured to be coupled, to the loudspeaker array.

There is provided a computer program comprising instructions which, when executed by a processing system, cause the processing system to perform any of the methods described herein.

There is provided a (non-transitory) computer-readable medium or a data carrier signal comprising the computer program.

In some implementations, the various methods described above are implemented by a computer program. In some implementations, the computer program includes computer code arranged to instruct a computer to perform the functions of one or more of the various methods described above. In some implementations, the computer program and/or the code for performing such methods is provided to an apparatus, such as a computer, on one or more computer-readable media or, more generally, a computer program product. The computer-readable media is transitory or non-transitory. The one or more computer-readable media could be, for example, an electronic, magnetic, optical, electromagnetic, infrared, or semiconductor system, or a propagation medium for data transmission, for example for downloading the code over the Internet. Alternatively, the one or more computer-readable media could take the form of one or more physical computer-readable media such as semiconductor or solid state memory, magnetic tape, a removable computer diskette, a random access memory (RAM), a read-only memory (ROM), a rigid magnetic disc, or an optical disk, such as a CD-ROM, CD-R/W or DVD.

In an implementation, the modules, components and other features described herein are implemented as discrete components or integrated in the functionality of hardware components such as ASICS, FPGAs, DSPs or similar devices.

A 'hardware component' is a tangible (e.g., non-transitory) physical component (e.g., a set of one or more processors) capable of performing certain operations and configured or arranged in a certain physical manner. In some implementations, a hardware component includes dedicated circuitry or logic that is permanently configured to perform certain operations. In some implementations, a hardware component is or includes a special-purpose processor, such as a field programmable gate array (FPGA) or an ASIC. In some implementations, a hardware component also includes programmable logic or circuitry that is temporarily configured by software to perform certain operations.

Accordingly, the term 'hardware component' should be understood to encompass a tangible entity that is physically constructed, permanently configured (e.g., hardwired), or temporarily configured (e.g., programmed) to operate in a certain manner or to perform certain operations described herein.

In addition, in some implementations, the modules and components are implemented as firmware or functional circuitry within hardware devices. Further, in some implementations, the modules and components are implemented in any combination of hardware devices and software components, or only in software (e.g., code stored or otherwise embodied in a machine-readable medium or in a transmission medium).

Those skilled in the art will recognise that a wide variety of modifications, alterations, and combinations can be made with respect to the above described examples without departing from the scope of the disclosed concepts, and that such modifications, alterations, and combinations are to be viewed as being within the scope of the present disclosure.

It will be appreciated that, although various approaches above may be implicitly or explicitly described as 'optimal', engineering involves tradeoffs and so an approach which is optimal from one perspective may not be optimal from another. Furthermore, approaches which are slightly sub-optimal may nevertheless be useful. As a result, both optimal and sub-optimal solutions should be considered as being within the scope of the present disclosure.

Those skilled in the art will also recognise that the scope of the invention is not limited by the examples described herein, but is instead defined by the appended claims.

The invention claimed is:

1. A method of controlling an array of loudspeakers, the method comprising:

receiving a plurality of input audio signals to be reproduced, by the array, at a respective plurality of control points in an acoustic environment; and generating a respective output audio signal for each of the loudspeakers in the array by applying a set of filters to the plurality of input audio signals, wherein the set of filters is based on:

a first plurality of filter elements based on a first approximation of a set of transfer functions, each transfer function in the set of transfer functions being between an audio signal applied to a respective one of the loudspeakers and an audio signal received at a respective one of the control points from the respective one of the loudspeakers; and a second plurality of filter elements based on a second approximation of the set of transfer functions, wherein the set of filters comprises:

a first subset of filters based on the first and second pluralities of filter elements; and a second subset of filters based on one of the first or second pluralities of filter elements, and wherein the array comprises L loudspeakers, the plurality of control points comprises M control points, the first subset of filters comprises $M^2$ filters, and the second subset of filters comprises L×M filters.

2. The method of claim 1, wherein the first approximation is based on a free-field acoustic propagation model and/or a point-source acoustic propagation model.

3. The method of claim 1, wherein the second approximation accounts for one or more of reflection, refraction, diffraction or scattering of sound in the acoustic environment.

4. The method of claim 1, wherein the second approximation accounts for one or more of a frequency response of each of the loudspeakers or a directivity pattern of each of the loudspeakers.

5. The method of claim 1, wherein generating the respective output audio signal for each of the loudspeakers in the array comprises:

generating a respective intermediate audio signal for each of the control points by applying a first subset of filters to the input audio signals; and generating the respective output audio signal for each of the loudspeakers by applying a second subset of filters to the intermediate audio signals.

6. The method of claim 1, wherein the set of filters is determined based on an inverse of a matrix containing the first and second pluralities of filter elements.

7. The method of claim 6, wherein the matrix containing the first and second pluralities of filter elements is determined based on:

in the frequency domain, a product of a matrix containing the second plurality of filter elements and a matrix containing the first plurality of filter elements; or an equivalent operation in the time domain.

8. The method of claim 6, wherein the set of filters is determined based on:

in the frequency domain, a product of a matrix containing the first plurality of filter elements and the inverse of the matrix containing the first and second pluralities of filter elements; or an equivalent operation in the time domain.

9. The method of claim 1, wherein each one of the first plurality of filter elements is a frequency-independent delay-gain element.

10. The method of claim 1, wherein each one of the first plurality of filter elements comprises a delay term and/or a gain term that is based on a relative position of one of the control points and one of the loudspeakers.

11. The method of claim 1, wherein each one of the first plurality of filter elements comprises a delay term and/or a gain term that is determined, for each given row of a first matrix comprising the first plurality of filter elements, so as to:

increase a collinearity between the given row of the first matrix and a corresponding row of a second matrix comprising the second plurality of filter elements; and optionally, reduce the collinearity between the given row of the first matrix and non-corresponding rows of the second matrix.

12. The method of claim 1, wherein the plurality of control points comprises locations of a corresponding plurality of listeners or locations of ears of one or more listeners.

13. The method of claim 1, wherein the second approximation is based on one or more head-related transfer functions, HRTFs.

14. The method of claim 1, further comprising determining the plurality of control points using a position sensor.

15. The method of claim 1, wherein generating the respective output audio signals comprises using a filter bank to apply at least a portion of the set of filters in a plurality of frequency subbands, wherein at least one of:

the first plurality of filter elements comprises a first subset of first filter elements for a first one of the plurality of frequency subbands and a second subset of first filter elements for a second one of the plurality of frequency subbands; or the second plurality of filter elements comprises a first subset of second filter elements for the first one of the plurality of frequency subbands and a second subset of second filter elements for the second one of the plurality of frequency subbands.

16. The method of claim 1, wherein the set of filters is time-varying.

17. An apparatus configured to:

receive a plurality of input audio signals to be reproduced, by the array, at a respective plurality of control points in an acoustic environment; and generate a respective output audio signal for each of the loudspeakers in the array by applying a set of filters to the plurality of input audio signals, wherein the set of filters is based on:

a first plurality of filter elements based on a first approximation of a set of transfer functions, each transfer function in the set of transfer functions being between an audio signal applied to a respective one of the loudspeakers and an audio signal received at a respective one of the control points from the respective one of the loudspeakers; and a second plurality of filter elements based on a second approximation of the set of transfer functions, wherein the set of filters comprises:

a first subset of filters based on the first and second pluralities of filter elements; and a second subset of filters based on one of the first or second pluralities of filter elements, and wherein the array comprises L loudspeakers, the plurality of control points comprises M control points, the first subset of filters comprises $M^2$ filters, and the second subset of filters comprises L×M filters.

18. A non-transitory computer-readable medium comprising instructions which, when executed by a processing system, cause the processing system to:

receive a plurality of input audio signals to be reproduced, by the array, at a respective plurality of control points in an acoustic environment; and generate a respective output audio signal for each of the loudspeakers in the array by applying a set of filters to the plurality of input audio signals, wherein the set of filters is based on:

a first plurality of filter elements based on a first approximation of a set of transfer functions, each transfer function in the set of transfer functions being between an audio signal applied to a respective one of the loudspeakers and an audio signal received at a respective one of the control points from the respective one of the loudspeakers; and a second plurality of filter elements based on a second approximation of the set of transfer functions, wherein the set of filters comprises:

a first subset of filters based on the first and second pluralities of filter elements; and a second subset of filters based on one of the first or second pluralities of filter elements, and wherein the array comprises L loudspeakers, the plurality of control points comprises M control points, the first subset of filters comprises $M^2$ filters, and the second subset of filters comprises L×M filters.

* * * * *